US006024503A

United States Patent [19]

Nakano et al.

[11] Patent Number: 6,024,503

[45] Date of Patent: Feb. 15, 2000

[54] PHOTOGRAPH DEVELOPING APPARATUS

[75] Inventors: Tsukasa Nakano, Han'nan; Tomoya Tanaka, Kainan; Takafumi Kimura; Yoshifumi Nakamura, both of Naga-gun; Junichi Miyai, Wakayama, all of Japan

[73] Assignee: Noritsu Koki Co,. Ltd., Wakayama, Japan

[21] Appl. No.: 09/159,508

[22] Filed: Sep. 24, 1998

[30] Foreign Application Priority Data

Sep. 26, 1997 [JP] Japan ..... 9-277933

[51] Int. Cl.[7] ..... G03D 13/04

[52] U.S. Cl. ..... 396/636; 396/641

[58] Field of Search ..... 396/626, 578, 396/636, 641

[56] References Cited

U.S. PATENT DOCUMENTS

| | | | |
|---|---|---|---|
| 4,312,586 | 1/1982 | Ohtani | 396/620 |
| 4,804,990 | 2/1989 | Jessop | 396/626 |
| 5,652,940 | 7/1997 | Saito | 396/620 |

OTHER PUBLICATIONS

Patent Abstracts of Japan, vol. 010, No. 052(P–432), Feb. 28, 1986, JP 60–194455, Oct. 2, 1985.

*Primary Examiner*—D. Rutledge

*Attorney, Agent, or Firm*—Oblon, Spivak, McClelland, Maier & Neustadt, P.C.

[57] ABSTRACT

A photograph developing apparatus includes a main processing tank and a sub-tank which is connected to the main processing tank. The sub-tank is provided with a filter, a sensor, and the like in order to filter processing solution and feed the filtered processing solution back to the main processing tank. The sub-tank has a lid for covering the top of the sub-tank. The lid has an evaporation prevention block which is extended to a point below the surface of the processing solution. Cavity portions are formed in the evaporation prevention block at least at positions corresponding to the filter and the sensor. Alternatively, evaporation of the processing solution is suppressed through employment of an evaporation prevention block which floats on the surface of the processing solution. In this case as well, cavity portions are formed in the block at least at positions corresponding to the filter and the sensor.

4 Claims, 4 Drawing Sheets

PHOTOGRAPH DEVELOPING APPARATUS

BACKGROUND OF THE INVENTION

1. Field of the Invention

The present invention relates to a photograph developing apparatus equipped with a sub-tank. More particularly, the present invention relates to the structure of the lid portion of the sub-tank.

2. Description of the Related Art

There are many kinds of automatic photographic printers such as a large-type photographic printer that can perform processing at high speed and a small-type photographic printer that can be installed in a retail shop or the like. Developing apparatus used in these printers have been improved to operate at higher speed, and photographic materials have progressed as well. In addition, developing temperature has been increased in order to accelerate chemical reaction. Especially, in development of a color photograph, the temperature of processing solution is set higher than in the case of a monochrome photograph.

Although development at high temperature is good in terms of processing speed, resultant enrichment of processing solution concentration due to evaporation causes difficulty in maintenance of the processing solution, such as management of processing solution concentration. If the concentration of the processing solution changes, the processing time and other processing conditions change. Therefore, there has been performed an operation for replenishing water at intervals in order to maintain the processing solution at constant concentration.

Recently, in consideration of cost and environmental problems, there has been developed a developing apparatus that performs development through use of a greatly reduced amount of processing solution. However, when the amount of processing solution decreases, resultant enrichment of processing solution concentration due to evaporation-which conventionally has not been a significant problem becomes a significant problem.

In a main processing tank, evaporation of processing solution is prevented through employment of a lid having a sealing structure. However, in a sub-tank provided for filtering, heating, and circulating processing solution from the main processing tank, employing a lid of a sealing structure as in the case of the main processing tank is difficult. That is, although the surface area of processing solution in the sub-tank is relatively small, various mechanisms such as a filter mechanism, a heating mechanism, a sensor mechanism, and a switch mechanism are present in the solution or on the solution surface, and the lid is frequently opened for adjustment and inspection, thus rendering difficult employment of a lid of a sealing structure.

Further, in the sub-tank, processing solution tends to evaporate from its surface more than in the main processing tank due to heating by the heating mechanism and due to turbulence at the surface of processing solution caused by flow of the processing solution. Moreover, reaction with air occurs more easily on a moving liquid surface as compared with a still liquid surface, and degradation of the processing solution proceeds more quickly.

SUMMARY OF THE INVENTION

In view of the foregoing, an object of the present invention is to provide a structure of a sub-tank that prevents evaporation of processing solution as well as degradation of the processing solution, which would otherwise occur due to contact with air.

In order to achieve the above object, the present invention provides a photograph developing apparatus having a main processing tank and a sub-tank which is connected to the main processing tank. The sub-tank is provided with filter means, sensor means, and the like in order to filter processing solution and feed the filtered processing solution back to the main processing tank. The sub-tank has a lid for covering the top of the sub-tank. The lid has an evaporation prevention block which is extended to a point below the surface of the processing solution. Cavity portions are formed in the evaporation prevention block at least at positions corresponding to the filter means, the sensor means, and other mechanism members disposed within the sub-tank.

The evaporation prevention block is formed integrally with the sub-tank lid such that a filter, a sensor, and other mechanism members penetrate the cavity portions of the evaporation prevention block. Therefore, the evaporation prevention block covers the surface of the processing solution between these mechanism members to thereby suppress evaporation of the processing solution.

Alternatively, evaporation of the processing solution may be suppressed through employment of an evaporation prevention block which floats on the surface of the processing solution while covering the surface. In this case as well, cavity portions are formed in the block at least at positions corresponding to the filter means, the sensor means, and other mechanisms disposed within the subtank.

In the developing apparatus of the present invention, the surface of processing solution within a sub-tank having a complicated profile can be covered in order to reliably prevent evaporation of the processing solution. Further, there can be prevented degradation of the processing solution, which would otherwise occur due to contact between a moving liquid surface and air.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DESCRIPTION OF THE PREFERRED EMBODIMENTS

Embodiments of the present invention will be described with reference to the drawings.

Figure 1:
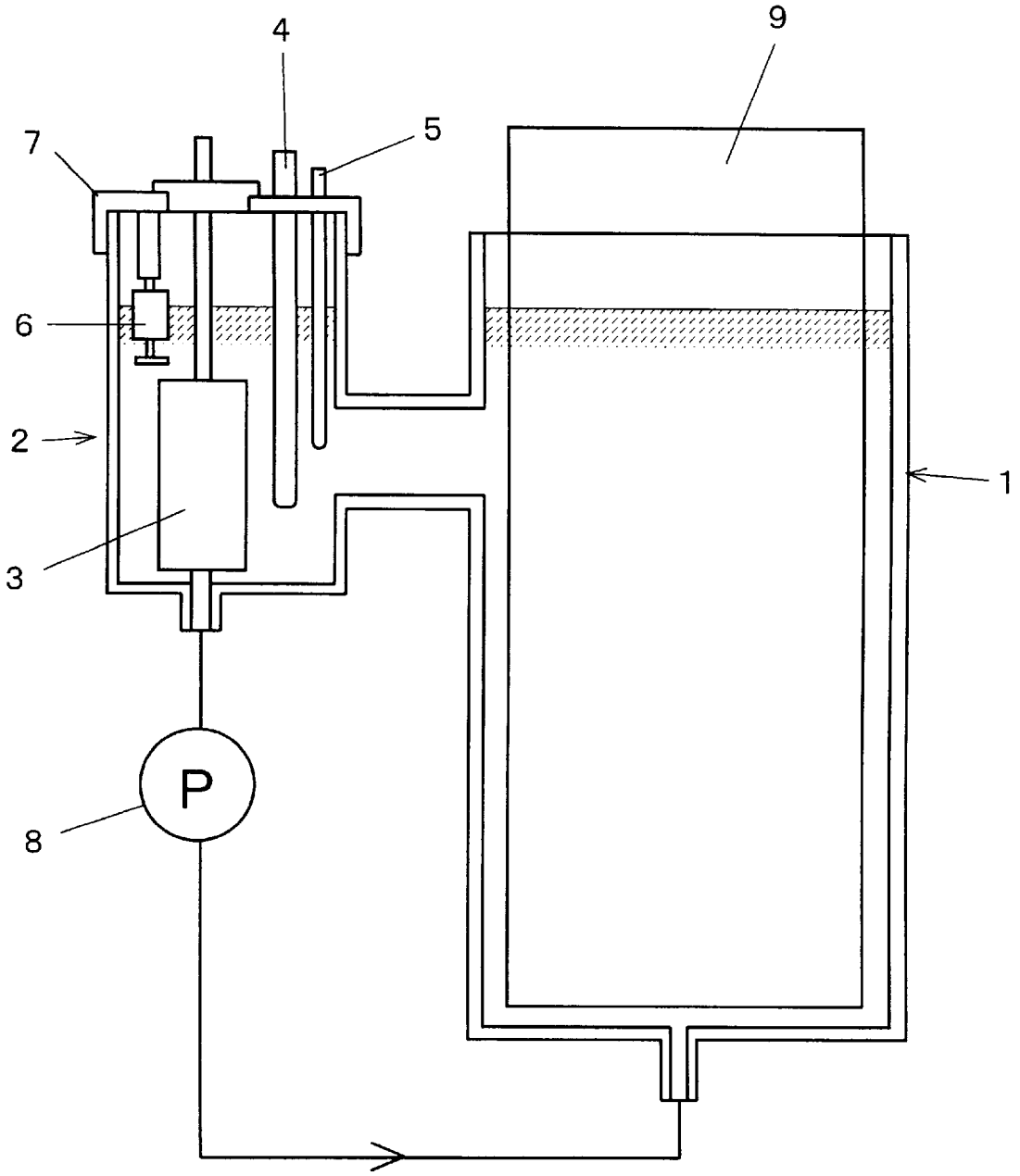
FIG. 1 PRIOR ART
FIG. 1 is a view of a conventional developing apparatus in which a main processing tank and a sub-tank are used in combination.

FIG. 1 shows a developing apparatus in which a main processing tank and a sub-tank are used in combination. Within a main processing tank 1 is disposed a submerged rack 9 for transporting a photosensitive material. A fluid passage that communicates with a sub-tank 2 is provided at an upper portion of the main processing tank 1.

Within the sub-tank 2 are disposed a filter 3 for filtering out paper dust and the like, a heater 4 for heating processing solution, a temperature detection bar 5 for detecting the temperature of the processing solution, and a float switch 6 for detecting the position of the surface of the processing solution, etc. Although not illustrated in FIG. 1, there may be provided other sensors, such as a pH meter, for measuring the conditions of the processing solution. The upper portion of the sub-tank is covered with a sub-tank cover 7.

The filtered solution flowing out from a discharge port provided at the bottom of the sub-tank is fed to the interior of the main processing tank by means of a circulation pump 8 and via an inlet port provided at the bottom of the main processing tank. Since various devices are disposed within the sub-tank, the surface of the processing solution has a complicated profile, and the surface moves due to the flow of circulated solution.

Figure 2:
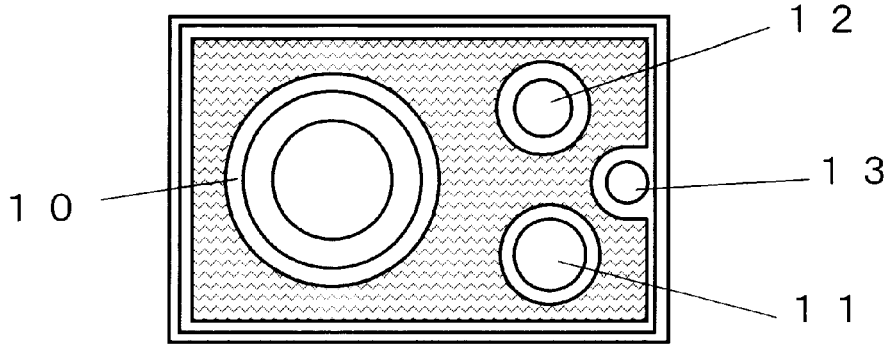
FIG. 2 is an explanatory view showing an example of the surface of processing solution in a sub-tank.

The arrangement of various devices within the sub-tank varies depending on the type of a developing apparatus. FIG. 2 shows the profile of the surface of processing solution in a sub-tank of another type. In this example, a portion of a filter 10 projects above the surface of the processing solution, and a float switch 11 and a heater 12 are disposed side by side. A temperature detection bar 13 is disposed along a wall.

Figure 3:
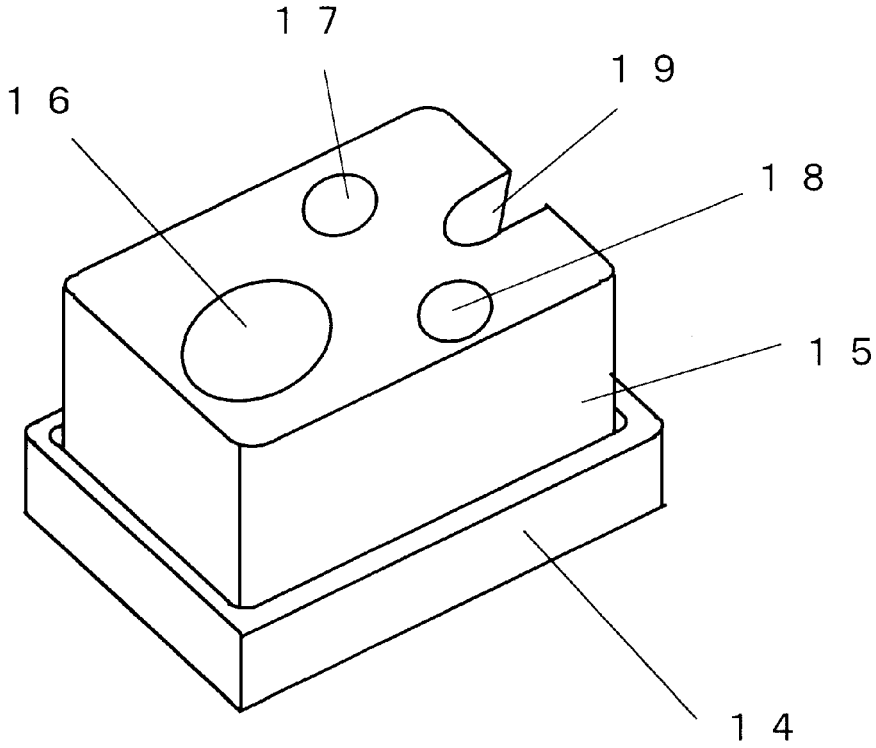
FIG. 3 is a perspective view showing an example of a sub-tank cover of the present invention.

In this case, the hatched portion of the surface of the processing solution must be covered. As shown in FIG. 3, a sub-tank cover 14 has an evaporation prevention block 15 for covering the hatched portion of the surface of the processing solution. The evaporation prevention block 15 has a cavity 16 for receiving the filter 10, a cavity 17 for receiving the float switch 11, a cavity 18 for receiving the heater 12, and a cavity 19 for receiving the temperature detection bar 13. The evaporation prevention block 15 has such a height that when the sub-tank cover 14 is attached to the sub-tank, at least the lower end reaches the surface of the processing solution.

Figure 4:
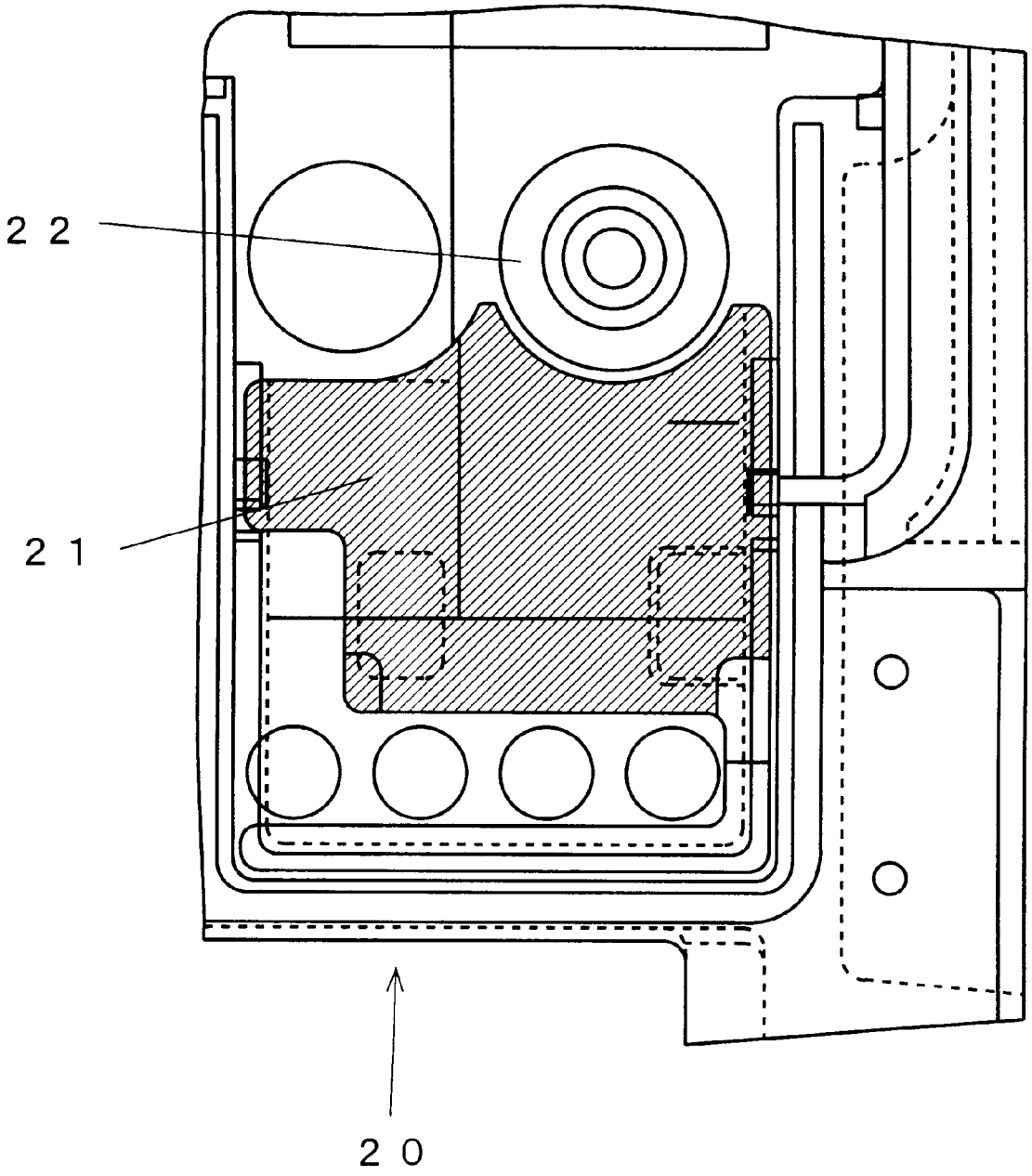
FIG. 4 is an explanatory view showing an example of an evaporation prevention block of the present invention placed on the surface of processing solution in a sub-tank.

FIG. 4 shows another embodiment of the present invention. Within a sub-tank 20, an evaporation prevention block 21 floats on the surface of processing solution. The evaporation prevention block 21 has a cross-sectional shape corresponding to the profile of the surface of the processing solution. Thus, the surface of the processing solution is prevented from contacting air. The cross-sectional shape of the evaporation prevention block 21 is determined so as to match the shapes of the sub-tank and the devices disposed within the sub-tank, such as a filter 22.

The block having such a simple shape has an advantage of easy removal. The sub-tank must be opened easily for cleaning of the filter. If the evaporation prevention block 21 has an excessively complicated shape, removal of the evaporation prevention block 21 becomes difficult, although the evaporation prevention block 21 may be able to cover the surface of the processing solution. Therefore, the shape of the evaporation prevention block 21 must be determined in consideration of these factors.

Figure 5:
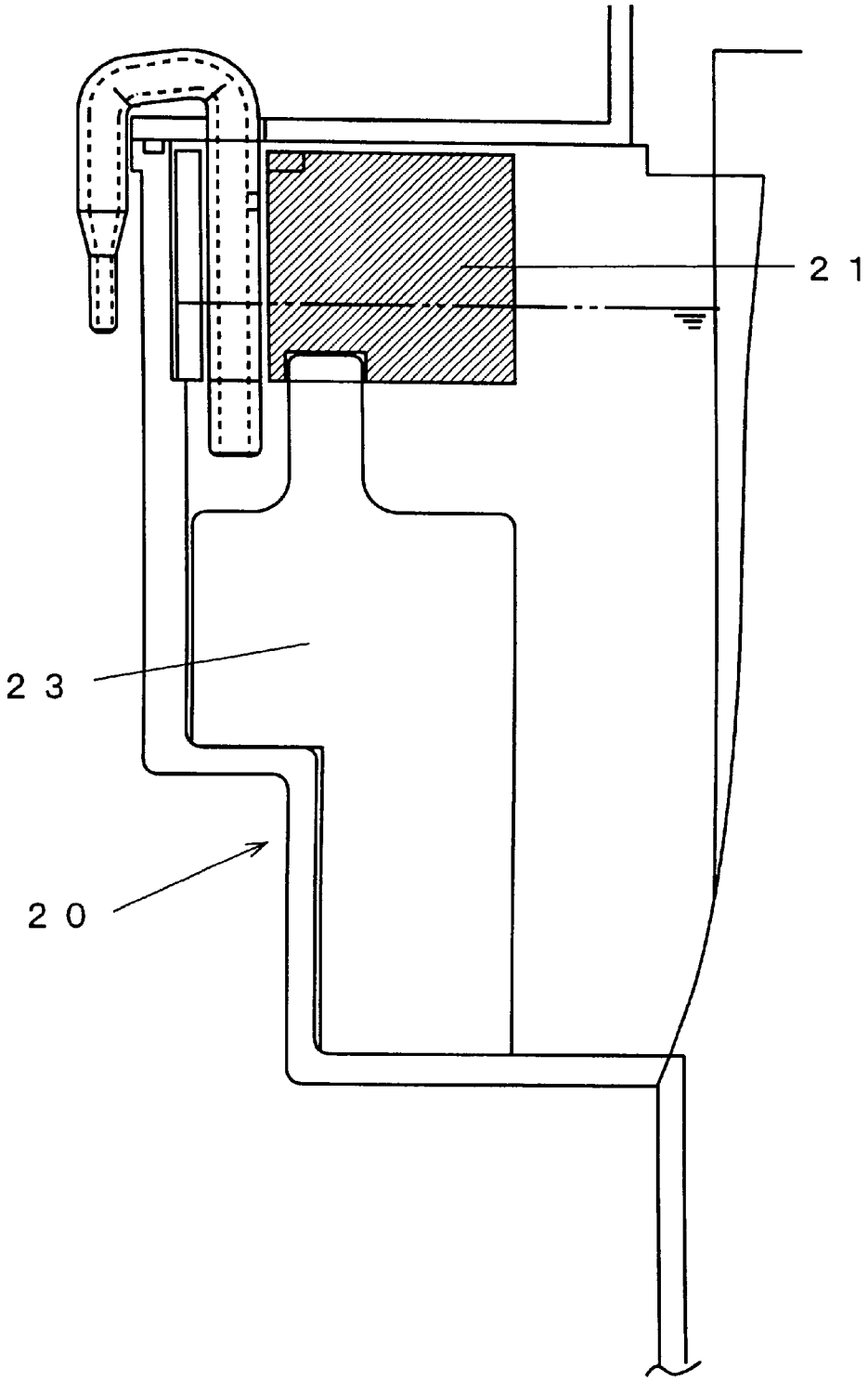
FIG. 5 is a sectional view showing a state in which the evaporation prevention block of the present invention is placed on the surface of processing solution in the sub-tank.

FIG. 5 shows a cross section of the apparatus of FIG. 4. As shown in FIG. 5, a liquid-amount-reduction block 23 is disposed under the surface of the processing solution in order to reduce the amount of the processing solution, and the evaporation prevention block 21 covers the surface of the processing solution in a state in which the top end of the liquid-amount-reduction block 23 is fitted into a depression formed in the bottom surface of the evaporation prevention block 21. When the evaporation prevention block 21 is supported from the bottom, the specific gravity of the evaporation prevention block 21 may be greater than that of the processing solution. However, when the evaporation prevention block 21 is not supported from the bottom, the specific gravity of the evaporation prevention block 21 must be made lower than that of the processing solution.

Obviously, numerous modifications and variations of the present invention are possible in light of the above teachings. It is therefore to be understood that within the scope of the appended claims, the present invention may be practiced otherwise than as specifically described herein.

What is claimed is:

1. A photograph developing apparatus having a main processing tank and a sub-tank which is connected to the main processing tank, said sub-tank being provided with at least filter means and sensor means in order to filter processing solution and feed the filtered processing solution back to said main processing tank, wherein said sub-tank has a lid for covering the top of said sub-tank, said lid having an evaporation prevention block which is extended to a point below the surface of the processing solution and which has cavity portions formed at least at positions corresponding to the positions of the filter means and the sensor means.

2. A photograph developing apparatus having a main processing tank and a sub-tank which is connected to the main processing tank, said sub-tank being provided with at least filter means and sensor means in order to filter processing solution and feed the filtered processing solution back to said main processing tank, wherein said sub-tank has an evaporation prevention block which is placed on the surface of the processing solution to cover the surface, said evaporation prevention block having cavities formed at least at positions corresponding to the positions of the filter means and the sensor means.

3. A photograph developing apparatus according to claim 2, wherein the evaporation prevention block has a specific gravity lower than that of the processing solution.

4. A photograph developing apparatus according to claim 2, wherein the evaporation prevention block has a specific gravity greater than that of the processing solution, and the evaporation prevention block is supported on a liquid-amount-reduction member disposed under the surface of the processing solution and adapted to reduce the amount of the processing solution.

* * * * *